United States Patent [19]

Snow

[11] Patent Number: 4,904,375

[45] Date of Patent: Feb. 27, 1990

[54] SODIUM SILICATE AS A PHOSPHATE FLOTATION MODIFIER

[75] Inventor: Robert E. Snow, Lakeland, Fla.

[73] Assignee: IMC Fertilizer, Inc., Northbrook, Ill.

[21] Appl. No.: 130,483

[22] Filed: Dec. 9, 1987

Related U.S. Application Data

[63] Continuation of Ser. No. 863,865, May 16, 1986, abandoned.

[51] Int. Cl.[4] ..... B03D 1/02

[52] U.S. Cl. ..... 209/166; 209/167

[58] Field of Search ..... 209/166, 167, 902, 5; 252/61

[56] References Cited

U.S. PATENT DOCUMENTS

| | | | |
|---|---|---|---|
| 1,547,732 | 6/1925 | Broadridge | 209/166 |
| 2,466,671 | 4/1949 | Gieske | 209/902 |
| 2,471,341 | 5/1949 | Moyer | 209/167 |
| 3,259,242 | 7/1966 | Snow | 209/902 |
| 3,259,326 | 7/1966 | Duke | 209/902 |
| 3,314,537 | 4/1967 | Green | 209/166 |
| 3,462,016 | 8/1969 | Bushell | 209/166 |
| 3,462,017 | 8/1969 | Bushell | 209/166 |
| 4,200,522 | 4/1980 | Dorrepaal | 209/166 |

FOREIGN PATENT DOCUMENTS

| | | | |
|---|---|---|---|
| 822902 | 4/1981 | U.S.S.R. | 209/166 |

OTHER PUBLICATIONS

Kirk Othmer, "Encyclopedia of Chemical Technology", vol. 20, 3rd Edition, pp. 869–870, 875–877.

Taggarts, "Handbook of Mineral Dressing", @1945, Section 12, pp. 124–125.

*Primary Examiner*—David L. Lacey

*Assistant Examiner*—Thomas M. Lithgow

*Attorney, Agent, or Firm*—Banner, Birch, McKie & Beckett

[57] ABSTRACT

This invention is directed to an improved froth flotation separation for beneficiating phosphate containing ores wherein an ore is preliminarily conditioned with an anionic agent and then subjected to froth flotation separation to concentrate the phosphate containing fraction. The improvement comprises the addition of sodium silicate near the end of the conditioning step before the beginning of the froth flotation.

12 Claims, 1 Drawing Sheet

SODIUM SILICATE AS A PHOSPHATE FLOTATION MODIFIER

This application is a continuation of application Ser. No. 863,865, filed May 16, 1986, now abandoned.

BACKGROUND OF THE INVENTION

The present invention relates to the beneficiation of phosphate-containing ore by froth flotation. More particularly, the invention relates to a beneficiation method wherein sodium silicate ($Na_2SiO_3$) is added to the final stage of conditioning and preparation for anionic froth flotation separation of phosphate-containing ores.

Phosphate-containing ores can be beneficiated by froth flotation separation. Typically, the ore is comminuted and classified according to particle size. Extremely fine material, for example, −150 mesh, contains primarily clay slimes and is usually discarded. Coarse fractions may be sold, further classified by particle size, or beneficiated by froth flotation separation.

Froth flotation separates the feed slurry into two streams; the froth, also called the float, which is removed from the surface of the flotation cell, and the underflow, or tailings, which are removed from the bottom of the flotation cell with the majority of the fluid. Subsequently, each stream may be further treated to purify it or to recover valuable compounds.

The impurities in the phosphate-containing ore are not only silicas. Dolomite and various minerals and metallic impurities are often present in varying quantities, as are many other impurities. Various techniques of froth flotation separation are known in the art, depending upon the identity of the impurities and whether it is desired to recover the phosphate values, i.e., the phosphate-containing concentrate, in the float or in the underflow. For example, compare the methods taught in U.S. Pat. Nos. 2,914,173 and 4,364,824.

Prior to entering the flotation machines, the phosphate-containing ore slurry is typically conditioned or reagentized, i.e., it is treated with various chemicals to increase the efficiency of the separation. Chemicals which are anionic are attracted to the phosphate fraction while the gangue, particularly, siliceous material, attracts cationic reagents. Other chemicals, such as modifiers, conditioning agents, and the like, are selected based on the plant operator's needs.

When an anionic agent is utilized in froth flotation of phosphate-containing ores, the concentrated phosphate is the froth. One of the expedients known to those who practice the art is to add sodium silicate, also known as waterglass, to the pre-flotation conditioning step. The sodium silicate acts as a silica depressant, a dispersant, or a pH adjuster, depending upon the identity of the other anionic agents. However, neither the value of selecting the proper timing for the addition of the sodium silicate nor the froth modifying ability of sodium silicate have heretofore been appreciated.

It is an object of this invention to provide a method for concentrating the phosphate-containing fraction of phosphate-containing ores by froth flotation separation.

It is a further object of this invention to provide a method of beneficiating phosphate-containing ores wherein sodium silicate is added to the final stages of conditioning before an anionic froth flotation separation is attempted.

SUMMARY OF THE INVENTION

In accordance with these and other objectives, this invention is directed to an improved froth flotation separation for beneficiating phosphate-containing ores. This invention is directed to a process wherein a phosphate ore is preliminarily conditioned in aqueous slurry form for a period of at least about two minutes with at least one anionic flotation agent in aqueous slurry form and then subjected to froth flotation separation to provide a phosphate-containing froth fraction, and contemplates the improvement comprising the addition of sodium silicate at a time not more than about 30 seconds before the end of said conditioning.

Although sodium silicate is a known agent which has been added to anionic flotations, it has surprisingly been found that the time of addition is very important in achieving an increased efficient phosphate recovery. This method of restricting the addition of the sodium silicate to less than about 30 seconds, but preferably between about 5 to 20 seconds, before the end of the conditioning step, improves froth control, reduces flotation oil consumption, and enhances selectivity of the flotation operation.

DETAILED DESCRIPTION OF THE INVENTION

Figures 1, 2, 3, 4, 5, 6, 7, 8:
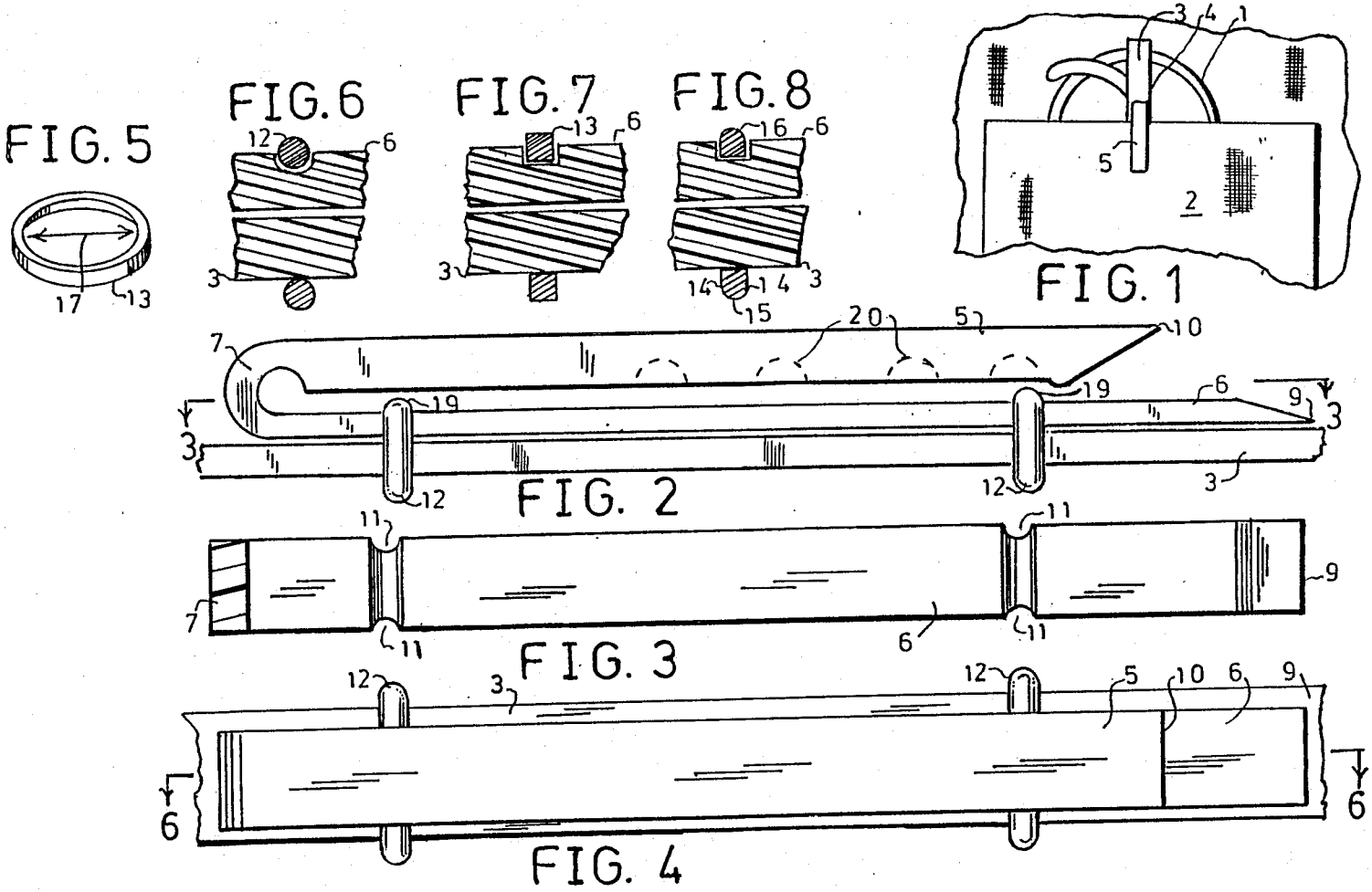
FIG. 1 is a schematic flow diagram for an embodiment in which this invention can be practiced.

The subject invention relates to the beneficiation of phosphate-containing ores by froth flotation separation wherein anionic agents are utilized to aid in the separation of the phosphate concentrates from the gangue. When anionic agents are used to enhance the separation, the desired phosphate concentrate is removed as the froth.

The invention is further illustrated by the drawing wherein the FIGURE is a schematic flow diagram of a preferred embodiment of the overall processing of phosphate-containing ores utilizing primarily an anionic flotation. The invention is not to be construed as being limited to the following embodiment.

Phosphate-containing ores from the mine typically are washed and rough sized in a washer. This ore may be comminuted in any fashion known in the art. Pebble product, i.e., those particles which can be utilized without further classification or treatment, generally is separated from the remainder of the phosphate-containing ore. This remainder, also called washer debris, is generally subjected to desliming.

Deslimed phosphate-containing ore is typically subject to screen sizing. Hydraulic sizing or any other method of particle classification by size can also be utilized. The deslimed phosphate-containing ore is depicted as classified into four fractions, but it can be divided into any number of fractions. Indeed, phosphate ore can be beneficiated without sizing beforehand. For ease of presentation, the process of this invention will be described with reference to the particular flow-sheet shown in the FIGURE but the invention is applicable to any process in which phosphate ore is conditioned and subjected to anionic flotation.

In the typical procedure depicted in the FIGURE, the four fractions are +16 mesh 55, −16+24 mesh 56, −24+35 mesh 57, and deslimed −35 mesh 58. "Mesh" refers to the Tyler designation for sieve sizes and "+n"

means those particles which are retained on a Tyler mesh sieve of "n" size. Similarly, "-n" means that the particles pass through Tyler mesh sieve of "n" size. Therefore, "−24+35 mesh" designates that fraction of the deslimed phosphate-containing ore which passes through a 24 mesh sieve but is retained on a 35 mesh sieve.

Typically, the fraction containing the largest particles, e.g., +16 mesh fraction 55, is returned to the washer so that it can be more precisely separated with the possibility that it may be comminuted or otherwise treated. The −16+24 mesh fraction 56 is dewatered and anionically conditioned 4, after which it is processed in spiral separator 7 which separates it into a desired spiral concentrate 59 and a tail or undesired product 60. However, as in any separation process, some of the desired product will remain mixed with the undesired stream, and some of the undesired product will remain with the desired phosphate-containing concentrate. Therefore, tailings 60 are processed in scavenger flotation 10 which divides the tailings 60 into desired scavenger float phosphate concentrate 61 and scavenger tailings underflow 62. The scavenger float phosphate concentrate 61 is sent to product, as is the spiral concentrate 59, while scavenger tailings 62 are sent to product waste.

The practice of this invention is directed to those streams that are conditioned and then subjected to anionic flotation, such as streams 57 and 58 in the FIGURE. The −24+35 mesh fraction 57 is dewatered and conditioned 5 before being forwarded to the coarse flotation cell 8. Similarly, the −35 mesh deslimed fraction 58 is dewatered and conditioned 6 before being forwarded to the fine floatation cell 9. During conditioning, reagents are added to an aqueous slurry of the ore and the ore is subjected to agitation. Slurries having a solids content in the conditioner of about 65 to 78% are not unusual. As is known to skilled artisans, highest solids concentrations are usually maintained for coarsest feeds, but this is a matter of choice. Typically, conditioning lasts at least about two minutes. Conditioning can last for about 3 or 5 minutes or even longer.

Conditioning is typically carried out in either of two common apparatus, the drum type conditioner or the vertical conditioner. Each is well-known in the art. A drum-type conditioner is less complicated to construct than the vertical conditioner, especially because the typical practice is to construct one large drum-type conditioner where a plurality of vertical conditioners would be used to ensure adequate mixing.

Although this invention can be practiced with either apparatus, the vertical conditioner is preferred. Those skilled in the art could easily design a system for introducing the sodium silicate to the point in either conditioner apparatus which yields the desired residence time. For example, a sparging arrangement could be utilized in a drum-type conditioner. In a vertical conditioner system, wherein a plurality of stages is usually utilized, the sodium silicate can be added to that spot in the final conditioner stage where the estimated residence time equals the desired sodium silicate treatment time.

In plant practice vertical conditioner stages are continuous operations. The stream to be treated is introduced to a tank from which product is drawn. The entire content of the tank is thoroughly agitated, typically with a cruciform propeller attached to a shaft rotated by a motor. Although the entire tank is vigorously agitated, the inflow and outflow means are generally placed so that each particle receives equivalent treatment time as it flows through the stage. As is known in the art, residence time of the particles is statistically determined in such continuous operations. Therefore, one skilled in the art and knowledgeable of the flow dynamics in this stage, into which the sodium silicate is injected, is able to calculate the duration of the exposure to the reagent.

Various agents are added during conditioning to increase the efficiency of flotation cells 8 and 9. Suitable anionic flotation agents which are useful in these flotation cells include, for example, higher unsaturated fatty acids, i.e., oleic, linoleic and abietic acids, nitroresin acid, tall oil, naphthenic acid, alkylsulfonated fatty acids, acid ester of high molecular weight aliphatic alcohols, and the soaps of such materials. Included within the term "soaps" of such anionic agents are the alkali metal and alkaline earth metal soaps such as sodium, potassium, aluminum, calcium, and magnesium soaps. Soaps may also be formed by reacting such reagents with ammonia or aqueous solutions thereof. For fatty acids, the amount of reagent required generally falls between about 0.5 and about 2 pounds of reagent per ton of ore. The amount of any flotation agent to be used is easily within the skill of the art.

Other reagents may also be added in various quantities during conditioning. Various oils such as the heavier fuel oils can be utilized. Fuel oil (e.g., about 0.5 to 2 pounds per ton of ore) is often utilized to control the character of the froth.

In addition, the pH in the conditioner is often adjusted to between about 8 to 10.2, preferably between about 8.5 to 10. Corresponding values of the pH in the flotation cell, wherein the solids concentration is reduced to between about 20 to 35 wt. %, are between 8.0 and 9.0. Ammonia is a preferred basic agent. The amount of ammonia required is dependent upon the water quality, the quantity and identity of the other reagents present, and the like, but is typically between 0.2 to 0.5 pounds per ton of ore. These are known reagents and once again their selection and parameters of use are within the skill of the art.

It has been discovered that an unexpected benefit can be obtained when sodium silicate is added during about the final 30 seconds, but preferably during the final about 20 seconds, before the flotation step rather than earlier during the conditioning step, or during the flotation itself. If the sodium silicate is added earlier during the conditioning, or during the flotation itself, the maximum benefit, as measured by the phosphate and silica concentrations in the recovered stream, is not achieved. The maximum benefit often is obtained from the sodium silicate addition if the sodium silicate is added during the last 5 to 15 seconds prior to the flotation.

As noted above, those skilled in the art are able to design a sparger or similar arrangement from a drum-type conditioner or calculate the injection point in the ultimate vertical conditioner stage so that the duration of the sodium silicate treatment can be limited. Typically, a vertical conditioner system has a plurality of stages, usually three or more. Typically, the stages have equal volumes. Because stages of equal volume have equal residence times, a two minute conditioning in a 3-stage system requires 40 seconds in each stage. Similarly, in a 4 or 5-stage system, each stage has a residence time of ¼ or 1/5 the length of the conditioning step. Under such conditions, it is quite easy to limit the duration of the treatment to less than about 30 seconds. If, however, the residence time of the last stage is longer than about 30 seconds, then an appropriate injection point, which will vary from apparatus to apparatus because of differences in flow geometry, must be established to achieve the preferred treatment duration.

The great variety of apparatus designs makes it impossible to describe every possible system by which sodium silicate can be introduced in accordance with the practice of this invention. The preferred embodiment of this invention requires that the sodium silicate be added after the typical anionic flotation agents have been allowed to react with the ore and before the high solids concentration has been diluted in preparation for froth flotation.

The amount of sodium silicate added is generally between about 0.1 to 2.0 pounds per ton of feed and is dependent mainly upon the allowable concentration of insoluble material in the phosphate concentrate. Any amount of sodium silicate will be effective in reducing the percent insolubles, but amounts in excess of 1.5 pounds of sodium silicate per ton of feed do not seem to provide any additional benefit. Excessive addition of sodium silicate can affect the pH of the solution. The optimum amount for any set of conditions readily can be determined by routine tests.

Any of the available forms of water soluble sodium silicate are satisfactory for the practice of this invention. Sodium silicate is usually available as solutions of varying densities. As known in the art, the various forms of sodium silicate have a ratio of $SiO_2/Na_2O$ of between about 0.5 to 3.75. It is preferred to use sodium silicate having a $SiO_2/Na_2O$ ratio of at least about 3.0, preferably about 3.2 Product having $SiO_2/Na_2O$ ratio of about 3.2 are available from the Philadelphia Quartz Company under the names "N-Brand" and "E-Brand".

The preferred form of sodium silicate is readily available, relatively inexpensive, and easy to handle. It is a liquid, typically having a density of about 41° Baume. Other physical forms of sodium silicate are less easy to handle. Further, sodium silicate having an $SiO_2/Na_2O$ ratio less than about 3.0 tends to cause undesirable changes in slurry pH.

In the flowsheet of the FIGURE, both the coarse flotation cell 8 and the fine flotation cell 9 are maintained in anionic condition. Therefore, the desired phosphate concentrates 65 and 66 are removed from the flotation cell as froth. Various agents which aid in the separation of phosphate concentrate from the gangue are introduced during conditioning and flotation as described herein. The tailings, 63 and 64 respectively, from cells 8 and 9 are generally sent to waste. These streams contain the siliceous material and other gangue.

To further purify the concentrated phosphate-containing streams 65 and 66, the froth is dewatered and scrubbed 11 with a suitable acid to remove the conditioning agents previously applied. It is then washed, dewatered, and conditioned 12 for an amine flotation 13 wherein the cationic nature of the agent (the amine) causes the gangue 68 to float and be removed to the tailing disposal system. The desired phosphate values 67 are sent to product storage. The technique disclosed in this invention is not suitable for use in the amine flotation cells.

Although the inventor does not wish to be bound by this theory, it is believed that, in the method of this invention, the sodium silicate acts as a froth modifier. Not only is there less silica in the froth, but also the froth is cleaner and more easily controlled. Further, the techniques taught in the art typically require that a reagent which is to act on a particle, e.g., a silica depressant, be added early in the conditioning step. Early addition of such reagents optimizes the effectiveness of the reagent by maximizing the period during which the reagents can act on the particles. Clearly, therefore, the method and purpose of the use to which sodium silicate is put in the method of this invention are dissimilar from those known in the art.

The following examples further illustrate the invention. These examples are included for illustrative purposes and are not intended to limit the scope of the invention. Throughout these examples, "BPL" means "bone phosphate of lime", $(Ca_3(PO_4)_2$, a measure of the phosphate concentration.

EXAMPLE 1

Example 1 comprises four plant tests done serially with approximately one half hour between measurements. Test A established the efficiency of a flotation cell when the N-Brand sodium silicate was added during the final 15 seconds of the conditioning. Test B illustrated, at essentially equivalent conditions, the effect of injecting the sodium silicate during the entire conditioning period. Test C illustrated that even when 150% of the soap used in Test B was utilized, phosphate recovery improved only slightly. Test D, begun one and one-half hours after test A and at essentially the same conditions, reinforced the data gathered in Test A and illustrated the efficiency of the method of the invention. These tests were done on the fine feed 58.

| | Feed 58 | Concentrate 66 | | Tail 64% BPL | | Feed 58 | Additives to Conditions GPM | | $Na_2SiO_3$ Addition | | Conditioner |
|---|---|---|---|---|---|---|---|---|---|---|---|
| TEST | wt % BPL | wt % BPL | wt % Insol | wt % BPL | Recovered | TPH | Soap | Fuel Oil | GPM | Location | 6 pH |
| A | 17.02 | 52.53 | 26.96 | 2.70 | 88.70 | 577 | 4.66 | 1.17 | 0.60 | Final 15 seconds | 9.24 |
| B | 15.75 | 52.59 | 26.73 | 11.54 | 34.24 | 579 | 4.60 | 1.16 | 0.60 | Entire conditioning | 9.25 |
| C | 15.30 | 52.88 | 27.28 | 7.92 | 56.73 | 581 | 6.87 | 1.16 | 0.60 | Entire conditioning | 9.28 |
| D | 15.02 | 47.02 | 33.63 | 1.86 | 91.23 | 579 | 4.83 | 1.16 | 0.60 | Final 15 seconds | 9.15 |

EXAMPLE 2

Example 2 comprises a series of 4 laboratory tests which illustrated the effect of sodium silicate concentration in the flotation cell, especially illustrating that even excessive amounts of sodium silicate did not cause great BPL loss. Varying amounts of "N-Brand" sodium silicate (41° Baume; $SiO_2/Na_2O=3.22$) available from Philadelphia Quartz Company were added to the feed to a coarse flotation cell during the final 15 seconds of coarse conditioning, i.e., after 1 and ¼ minute. The feed slurry contained approximately 70 weight percent solids. Flotation and froth control agents were added at the rate of 1.5 pounds tall oil and 3.0 pounds of oil per ton of feed. Ammonia was used as the pH adjuster. The results of the tests were as follows:

| Test | "N-Brand" $Na_2SiO_3$, lb/T feed | Concentrate wt % BPL | Concentrate wt % Insol | Tail wt % BPL | wt % BPL Recovered | Conditioner pH | Flotation Cell pH |
|---|---|---|---|---|---|---|---|
| E | 0 | 29.5 | 61.0 | 2.11 | 92.3 | 9.3− | 8.3− |
| F | 0.43 | 56.4 | 26.4 | 1.98 | 89.6 | 9.2+ | 8.4 |
| G | 0.86 | 57.4 | 24.3 | 2.15 | 88.6 | 9.4− | N/A |
| H | 1.72 | 57.5 | 24.0 | 2.24 | 89.1 | 9.4− | 8.5 |

EXAMPLE 3

Example 3 comprises two series of 5 laboratory tests each, plus a series of 4 laboratory tests, designed to illustrate that it is best to inject sodium silicate during the last 15 seconds of conditioning rather than directly into the flotation cell. The pH in the conditioner was maintained at 9.2 throughout the series and the weight ratio of fuel oil to soap was 1 for every test. The feed was a fine feed.

| First Series - No Sodium Silicate Utilized | | | | | |
|---|---|---|---|---|---|
| | Feed | Concentrate | | Tail | |
| Soap lb/T feed | wt % BPL | wt % BPL | wt % Insol | wt % BPL | wt % BPL Recovery |
| 0.5 | 10.18 | 54.88 | 25.93 | 2.07 | 82.79 |
| 0.6 | 10.25 | 44.11 | 40.47 | 1.30 | 89.97 |
| 0.7 | 10.15 | 36.57 | 51.53 | 1.13 | 91.71 |
| 0.8 | 10.06 | 34.79 | 52.56 | 1.05 | 92.35 |
| 0.9 | 10.30 | 32.39 | 54.07 | 1.22 | 91.60 |

| Second Series - 0.5 lb $Na_2SiO_3$/T feed Added During Last 15 Seconds of Conditioning | | | | | |
|---|---|---|---|---|---|
| | Feed | Concentrate | | Tail | |
| Soap lb/T feed | wt % BPL | wt % BPL | wt % Insol | wt % BPL | wt % BPL Recovery |
| 0.6 | 10.32 | 60.28 | 18.48 | 1.64 | 86.46 |
| 0.8 | 10.34 | 52.57 | 29.34 | 1.22 | 90.29 |
| 1.0 | 10.42 | 50.58 | 31.67 | 1.01 | 92.15 |
| 1.2 | 10.62 | 45.68 | 39.51 | 1.01 | 92.53 |
| 1.4 | 9.96 | 31.20 | 57.54 | 0.84 | 94.10 |

| Third Series - 0.5 lb $Na_2SiO_3$/T feed Added to Flotation Cell | | | | | |
|---|---|---|---|---|---|
| | Feed | Concentrate | | Tail | |
| Soap lb/T feed | wt % BPL | wt % BPL | wt % Insol | wt % BPL | wt % BPL Recovery |
| 0.6 | 10.05 | 51.77 | 30.51 | 1.48 | 87.79 |
| 0.8 | 10.29 | 37.97 | 48.54 | 1.10 | 91.97 |
| 1.0 | 10.25 | 29.60 | 58.71 | 1.01 | 93.33 |
| 1.2 | 9.97 | 24.97 | 63.19 | 0.97 | 93.92 |

EXAMPLE 4

Tests were run on 5 different feeds to confirm that the point at which sodium silicate should be injected to achieve the highest weight percent BPL and concentrate value at a given weight percent BPL recovery is during the final period of conditioning. "N-Brand" sodium silicate was added at a rate of 0.7 pounds per tone of feed at various times during a 1.5 minute conditioning period. The pH of the conditioner was adjusted to 9.2 using ammonia and the solids concentration in the conditioner was approximately 70%.

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Feed 1 - Coarse Feed | | | | | | |
| First Series - No Sodium Silicate Added | | | | | | |
| 0.8 | 0.8 | 26.53 | 56.99 | 22.19 | 3.80 | 91.80 |
| 1.0 | 1.0 | 26.23 | 42.57 | 41.39 | 4.78 | 92.12 |
| 1.2 | 1.2 | 26.65 | 40.43 | 46.35 | 4.51 | 93.50 |
| 1.4 | 1.4 | 26.39 | 38.02 | 47.62 | 3.45 | 95.60 |
| 2.0 | 2.0 | 27.00 | 34.89 | 51.19 | 3.99 | 96.23 |
| Second Series - 0.7 lb $Na_2SiO_3$/T feed Added During Last 15 Seconds of Conditioning | | | | | | |
| 1.0 | 1.0 | 27.05 | 64.56 | 12.24 | 4.88 | 88.66 |
| 1.4 | 1.4 | 27.78 | 55.93 | 24.28 | 3.41 | 93.42 |
| 1.8 | 1.8 | 26.85 | 45.27 | 37.77 | 3.28 | 94.64 |
| 2.0 | 2.0 | 26.59 | 39.44 | 45.54 | 3.20 | 95.73 |
| 2.4 | 2.4 | 26.28 | 35.74 | 50.13 | 3.02 | 96.68 |
| First Comparison Point - 0.7 lb $Na_2SiO_3$/T feed Added to Flotation Cell | | | | | | |
| 2.0 | 2.0 | 26.72 | 36.20 | 50.37 | 3.64 | 96.04 |
| Second Comparison Point - 0.7 lb $Na_2SiO_3$/T feed Added at Start of Conditioning | | | | | | |
| 2.0 | 2.0 | 26.44 | 52.89 | 27.78 | 4.53 | 90.64 |

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Feed 2 - Fine Feed | | | | | | |
| First Series - No Sodium Silicate Added | | | | | | |
| 0.4 | 0.4 | 6.89 | 57.50 | 22.75 | 1.79 | 76.41 |
| 0.5 | 0.5 | 6.55 | 38.74 | 47.38 | 1.00 | 86.99 |
| 0.6 | 0.6 | 6.43 | 31.03 | 57.15 | 0.82 | 89.62 |
| 0.7 | 0.7 | 6.46 | 24.87 | 65.91 | 0.82 | 90.29 |
| 0.8 | 0.8 | 6.29 | 20.53 | 70.82 | 0.73 | 91.66 |
| Second Series - 0.7 lb $Na_2SiO_3$/T feed Added During Last 15 Seconds of Conditioning | | | | | | |
| 0.6 | 0.6 | 6.50 | 55.03 | 25.27 | 1.08 | 85.06 |
| 0.8 | 0.8 | 6.56 | 44.02 | 40.12 | 0.97 | 87.13 |
| 1.0 | 1.0 | 6.47 | 40.92 | 43.80 | 0.80 | 89.38 |
| 1.2 | 1.2 | 6.31 | 37.28 | 49.40 | 0.72 | 90.34 |
| 1.4 | 1.4 | 6.30 | 23.42 | 67.00 | 0.80 | 90.39 |
| First Comparison Point - 0.7 lb $Na_2SiO_3$/T feed Added to Flotation Cell | | | | | | |
| 0.8 | 0.8 | 6.38 | 19.27 | 73.33 | 0.82 | 91.03 |
| Second Comparison Point - 0.7 lb $Na_2SiO_3$/T feed Added at Start of Conditioning | | | | | | |
| 0.8 | 0.8 | 6.55 | 52.93 | 28.29 | 1.05 | 85.66 |

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Feed 3 - Coarse Feed | | | | | | |
| First Series - No Sodium Silicate Added | | | | | | |
| 0.6 | 0.6 | 13.88 | 60.81 | 18.04 | 6.31 | 60.86 |
| 0.7 | 0.7 | 13.88 | 55.56 | 25.56 | 4.69 | 72.30 |
| 0.8 | 0.8 | 13.38 | 51.73 | 31.49 | 4.11 | 75.25 |
| 0.9 | 0.9 | 13.52 | 48.40 | 33.90 | 4.16 | 75.75 |
| 1.0 | 1.0 | 13.72 | 45.89 | 37.66 | 3.86 | 78.47 |

-continued

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Second Series - 0.7 lb $Na_2SiO_3$/T feed Added During Last 15 Seconds of Conditioning | | | | | | |
| 0.8 | 0.8 | 13.61 | 65.39 | 12.40 | 4.33 | 73.02 |
| 1.0 | 1.0 | 13.60 | 62.40 | 16.76 | 3.73 | 77.19 |
| 1.2 | 1.2 | 13.87 | 58.53 | 21.23 | 3.43 | 79.96 |
| 1.4 | 1.4 | 14.25 | 56.58 | 24.49 | 3.56 | 80.05 |
| 1.6 | 1.6 | 13.04 | 43.37 | 36.27 | 2.34 | 86.74 |
| First Comparison Points - 0.7 lb $Na_2SiO_3$/T feed Added to Flotation Cell | | | | | | |
| 0.8 | 0.8 | 13.58 | 55.37 | 25.80 | 4.20 | 74.75 |
| 1.0 | 1.0 | 13.53 | 44.00 | 41.30 | 3.52 | 80.41 |
| Second Comparison Points - 0.7 lb $Na_2SiO_3$/T feed Added at Start of Conditioning | | | | | | |
| 1.0 | 1.0 | 13.05 | 64.33 | 14.13 | 5.23 | 65.21 |
| 1.4 | 1.4 | 13.68 | 58.73 | 21.23 | 3.74 | 77.59 |

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Feed 4 - Fine Feed First Series - No Sodium Silicate Added | | | | | | |
| 0.40 | 0.60 | 18.51 | 66.41 | 10.89 | 4.55 | 80.97 |
| 0.45 | 0.68 | 18.33 | 56.34 | 23.17 | 1.56 | 94.10 |
| 0.50 | 0.75 | 18.27 | 50.76 | 30.59 | 0.85 | 96.97 |
| 0.55 | 0.83 | 18.21 | 52.07 | 28.83 | 1.02 | 96.28 |
| 0.60 | 0.90 | 18.80 | 37.54 | 47.99 | 1.13 | 96.91 |
| Second Series - 0.7 lb $Na_2SiO_3$/T feed Added During Last 15 Seconds of Conditioning | | | | | | |
| 0.50 | 0.75 | 18.48 | 67.66 | 9.27 | 2.24 | 90.89 |
| 0.60 | 0.90 | 18.66 | 61.68 | 16.81 | 1.13 | 95.70 |
| 0.70 | 1.05 | 18.58 | 55.07 | 25.35 | 0.96 | 96.52 |
| 0.80 | 1.20 | 18.36 | 47.06 | 35.54 | 0.87 | 97.06 |
| 0.90 | 1.35 | 18.51 | 44.17 | 38.85 | 0.79 | 97.48 |
| First Comparison Points - 0.7 lb $Na_2SiO_3$/T feed Added to Flotation Cell | | | | | | |
| 0.50 | 0.75 | 18.34 | 60.14 | 18.23 | 1.39 | 94.61 |
| 0.60 | 0.90 | 18.64 | 45.40 | 37.90 | 0.96 | 96.90 |
| Second Comparison Points - 0.7 lb $Na_2SiO_3$/T feed Added at Start of Conditioning | | | | | | |
| 0.60 | 0.90 | 18.53 | 62.78 | 15.55 | 2.24 | 91.16 |
| 0.80 | 1.20 | 18.59 | 52.47 | 29.03 | 1.47 | 94.74 |

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| Feed 5 - Coarse Feed First Series - No Sodium Silicate Added | | | | | | |
| 0.50 | 0.75 | 26.76 | 69.96 | 5.74 | 6.99 | 82.08 |
| 0.60 | 0.90 | 26.81 | 67.64 | 9.11 | 2.70 | 93.67 |
| 0.70 | 1.05 | 26.88 | 64.23 | 12.97 | 1.93 | 95.69 |
| 0.80 | 1.20 | 26.73 | 55.92 | 24.29 | 1.89 | 96.18 |
| 0.90 | 1.35 | 26.44 | 49.47 | 33.27 | 1.55 | 97.18 |
| Second Series - 0.7 lb $Na_2SiO_3$/T feed Added During Last 15 Seconds of Conditioning | | | | | | |
| 0.60 | 0.90 | 26.01 | 69.76 | 6.11 | 3.69 | 90.61 |
| 0.80 | 1.20 | 26.46 | 67.24 | 8.97 | 2.06 | 95.13 |
| 1.00 | 1.50 | 26.79 | 58.13 | 21.22 | 1.46 | 96.99 |
| 1.10 | 1.65 | 26.55 | 49.86 | 31.25 | 1.59 | 97.11 |
| 1.20 | 1.80 | 26.72 | 42.54 | 41.58 | 1.76 | 97.45 |

-continued

| Soap lb/T feed | Fuel Oil lb/T feed | Feed wt % BPL | Concentrate wt % BPL | Concentrate wt % Insol | Tail wt % BPL | wt % BPL Recovery |
|---|---|---|---|---|---|---|
| First Comparison Points - 0.7 lb $Na_2SiO_3$/T feed Added to Flotation Cell | | | | | | |
| 0.80 | 1.20 | 26.83 | 55.02 | 25.58 | 1.64 | 96.77 |
| 0.90 | 1.35 | 26.62 | 49.49 | 32.24 | 1.55 | 97.22 |
| Second Comparison Point - 0.7 lb $Na_2SiO_3$/T feed Added at Start of Conditioning | | | | | | |
| 0.90 | 1.35 | 26.20 | 65.12 | 12.07 | 4.03 | 90.20 |

Since modification of this invention will be apparent to those skilled in the art, it is intended that this invention be limited only by the scope of the appended claims.

I claim:

1. A method of beneficiating a finely divided phosphate-containing ore wherein said ore is preliminarily conditioned for a period at least about 1 minute in aqueous slurry form with anionic agents, said conditioned slurry thereafter being subjected to froth flotation separation to provide a phosphate-containing froth concentrate fraction and separate said froth concentrate fraction from the gangue in said ore, the improvement comprising the addition to said slurry during the final period of said conditioning not more than about 30 seconds before the end of said conditioning of an amount of sodium silicate sufficient to enhance the said separation.

2. The method of claim 1 wherein at least 0.1 pounds of sodium silicate is added per ton of said ore.

3. The method of claim 1 wherein between about 0.1 to 1.5 pounds of sodium silicate is added per ton of said ore.

4. The method of claim 1 wherein sodium silicate has a $SiO_2/Na_2O$ ratio of at least about 3.0.

5. The method of claim 1 wherein between about 0.1 to 1.5 pounds of sodium silicate having a $SiO_2/Na_2O$ ratio of at least about 3.0 is added per ton of said ore.

6. The method of claim 1 wherein the pH of the conditioned slurry is at least 8.

7. The method of claim 1 wherein the pH of the conditioned slurry is between about 8.5 and 10.

8. The method of claim 1 wherein between about 0.1 to 1.5 pounds of sodium silicate having a $SiO_2/Na_2O$ ratio of at least about 3.0 is added per ton of said ore and the pH of said conditioned slurry is between about 8.5 and 10.

9. The method of claim 1 wherein the sodium silicate is added between about 5 to 10 seconds before the end of said conditioning step.

10. The method of claim 1 wherein between about 0.1 to 1.5 pounds of sodium silicate is added per ton of said ore between about 5 to 20 seconds before the end of said conditioning step.

11. The method of claim 1 wherein the pH of said conditioned slurry step is between about 8.5 to 10 and between about 0.5 to 1.5 pounds of sodium silicate having a $SiO_2/Na_2O$ ratio of at least about 3.0 is added per ton of said ore between about 5 to 20 seconds before the end of said conditioning step.

12. The method of claim 1 wherein between about 0.1 to 1.5 pounds of sodium silicate having a $SiO_2/Na_2O$ ratio of at least about 3.0 is added per ton of said ore between about 5 to 20 seconds before the end of said conditioning step.

* * * * *